US011604486B2

(12) United States Patent
Mallard et al.

(10) Patent No.: US 11,604,486 B2
(45) Date of Patent: Mar. 14, 2023

(54) VOLTAGE REGULATOR

(71) Applicant: NXP USA, Inc., Austin, TX (US)

(72) Inventors: Thomas Mallard, Toulouse (FR); Olivier Tico, St LYS (FR)

(73) Assignee: NXP USA, Inc., Austin, TX (US)

( * ) Notice: Subject to any disclaimer, the term of this patent is extended or adjusted under 35 U.S.C. 154(b) by 124 days.

(21) Appl. No.: 17/322,475

(22) Filed: May 17, 2021

(65) Prior Publication Data

US 2021/0397210 A1 Dec. 23, 2021

(30) Foreign Application Priority Data

Jun. 22, 2020 (EP) ..... 20305681

(51) Int. Cl.
*G05F 3/26* (2006.01)
*G05F 3/22* (2006.01)

(52) U.S. Cl.
CPC ..... *G05F 3/267* (2013.01); *G05F 3/225* (2013.01)

(58) Field of Classification Search
CPC ..... G05F 1/463; G05F 1/468; G05F 1/567; G05F 1/575; G05F 3/22; G05F 3/222; G05F 3/225; G05F 3/227; G05F 3/242; G05F 3/345; G05F 3/247; G05F 3/265; G05F 3/267; G05F 3/30
See application file for complete search history.

(56) References Cited

U.S. PATENT DOCUMENTS

| | | | | |
|---|---|---|---|---|
| 3,930,172 | A | 12/1975 | Dobkin | |
| 5,966,006 | A * | 10/1999 | Migliavacca | G05F 3/30 323/907 |
| 6,580,261 | B1 | 6/2003 | Dow | |
| 7,030,598 | B1 | 4/2006 | Dow | |
| 9,104,222 | B2 | 8/2015 | Pigott | |
| 9,385,689 | B1 * | 7/2016 | Thakur | G05F 3/267 |
| 9,501,081 | B2 | 11/2016 | Pigott | |
| 2015/0227156 | A1 * | 8/2015 | Kobayashi | G05F 3/16 323/268 |
| 2016/0026204 | A1 * | 1/2016 | de Cremoux | G05F 3/30 323/314 |
| 2016/0139621 | A1 * | 5/2016 | Niederberger | G05F 3/267 323/313 |

FOREIGN PATENT DOCUMENTS

EP 1783578 A1 5/2007

* cited by examiner

*Primary Examiner* — Fred E Finch, III

(57) ABSTRACT

A voltage regulator comprising a reference current generator coupled between a supply terminal and a reference terminal and configured to provide a reference current that is independent of an operating range of a supply voltage; and a regulator stage comprising: a current terminal configured to receive the reference current; a NMOS transistor having: a gate coupled to the current terminal; a drain coupled to the supply terminal; and a source coupled to an output terminal; a voltage reference circuit for providing a regulated output voltage coupled between the output terminal and the reference terminal, the voltage reference circuit comprising an output resistor coupled in series with a conduction channel of an output bipolar transistor arranged in a diode-connected configuration; an input bipolar transistor having: a conduction channel coupled between the current terminal and the reference terminal; and a base terminal coupled to a base terminal of the output bipolar transistor.

20 Claims, 5 Drawing Sheets

VOLTAGE REGULATOR

FIELD

The present disclosure relates to a voltage regulator and in particular to a voltage regulator for a battery management system.

SUMMARY

According to a first aspect of the present disclosure there is provided a voltage regulator comprising:

- a supply terminal configured to receive a supply voltage;
- a reference terminal;
- an output terminal configured to provide a regulated output voltage;
- a reference current generator coupled between the supply terminal and the reference terminal and configured to provide a reference current that is independent of an operating range of the supply voltage; and
- a regulator stage comprising:
  - a current terminal configured to receive the reference current from the reference current generator;
  - a NMOS transistor having:
    - a gate terminal coupled to the current terminal;
    - a drain terminal coupled to the supply terminal; and
    - a source terminal coupled to the output terminal;
  - a voltage reference circuit coupled between the output terminal and the reference terminal and configured to provide the regulated output voltage, the voltage reference circuit comprising a first output resistor coupled in series with a conduction channel of an output bipolar transistor, wherein the output bipolar transistor is arranged in a diode-connected configuration;
  - an input bipolar transistor having: a conduction channel coupled between the current terminal and the reference terminal; and a base terminal coupled to a base terminal of the output bipolar transistor such that the input bipolar transistor and the output bipolar transistor form a bipolar current mirror for mirroring the reference current through the voltage reference circuit.

The disclosed voltage regulators provide a low impedance output which can enable a fast-transient response to strong line regulation or load regulation variations. If a load current decreases in a step-wise manner then the negative feedback loop of the regulator stage can rapidly respond to maintain the regulated output voltage. The low impedance output can also have reduced sensitivity to variations in load mismatch.

The NMOS transistor, the bipolar current mirror and the first output resistor may be arranged in a negative feedback loop and configured to pull a mirrored reference current from the NMOS transistor through the first output resistor and the output bipolar transistor.

The negative feedback loop can pull a large current from the supply terminal, through the NMOS transistor, maintaining a fixed regulator output voltage over a wide range of load currents (up to tens of mA) with a high degree of accuracy.

In one or more embodiments the input bipolar transistor and the output bipolar transistor may be matched to bipolar transistors of the reference current generator. The first output resistor may be matched to an output current resistor of the reference current generator.

Matching the bipolar transistors and resistors of the reference current generator and the regulator stage can provide an output voltage with high accuracy that is insensitive to any variation in process, temperature or environment.

In one or more embodiments the input bipolar transistor and the output bipolar transistor may be matched to the bipolar transistors of the reference current generator by each transistor sharing one or more of: a same type, a same temperature coefficient, a same fabrication process, a same wafer, a same time of manufacture and/or a same location on the layout. The first output resistor may be matched to the output current resistor of the reference current generator by each resistor sharing one or more of: a same type, a same temperature coefficient, a same fabrication process, a same wafer, a same time of manufacture and/or a same location on the layout.

In one or more embodiments a resistance of the first output resistor may be selected such that a voltage across the first output resistor upon receipt of a mirrored reference current compensates a complementary to absolute temperature, CTAT, voltage component of the output bipolar transistor.

In one or more embodiments a ratio of an effective size of the output bipolar transistor to an effective size of the input bipolar transistor may be selected such that a voltage across the first output resistor upon receipt of the mirrored reference current compensates a complementary to absolute temperature, CTAT, voltage component of the output bipolar transistor.

In one or more embodiments the voltage reference circuit may comprise one or more further voltage reference blocks coupled in series with the first output resistor and the output bipolar transistor between the output terminal and the reference terminal. Each further voltage reference block may comprise:

- a further output resistor; and
- a further bipolar transistor arranged having a conduction channel connected in series with the further output resistor.

In one or more embodiments the further bipolar transistor may be arranged in a diode connected configuration.

In one or more embodiments the further voltage reference block may comprise:

- a first further division resistor coupled between a base terminal of the further bipolar transistor and a first conduction channel terminal of the further bipolar transistor; and
- a second further division resistor coupled between the base terminal of the further bipolar transistor and a second conduction channel terminal of the further bipolar transistor.

In one or more embodiments a resistance of each further output resistor may be selected such that a voltage across the further output resistor upon receipt of a mirrored reference current compensates a complementary to absolute temperature, CTAT, voltage component of the corresponding further bipolar transistor.

In one or more embodiments each further bipolar transistor may be matched to the output bipolar transistor and bipolar transistors of the reference current generator. Each further output resistor may be matched to the first output resistor and an output current resistor of the reference current generator.

In one or more embodiments each further bipolar transistor may be matched to the output bipolar transistor and bipolar transistors of the reference current generator by each transistor sharing one or more of: a same type, a same temperature coefficient, a same fabrication process, a same wafer, a same time of manufacture and/or a same location on the layout. Each further output resistor may be matched to the first output resistor and an output current resistor of the reference current generator by each resistor sharing one or more of: a same type, a same temperature coefficient, a same fabrication process, a same wafer, a same time of manufacture and/or a same location on the layout.

In one or more embodiments the further bipolar transistor may be a NPN bipolar transistor In one or more embodiments the input bipolar transistor and the output bipolar transistors may be NPN bipolar transistors.

In one or more embodiments the reference current generator may comprise:

a bias resistance;
a first bipolar transistor;
a second bipolar transistor;
a third bipolar transistor;
a fourth bipolar transistor; and
an output current resistor, wherein:

the bias resistance is coupled to the supply terminal and configured to provide a bias current to a conduction channel of the fourth bipolar transistor;
the conduction channel of the fourth bipolar transistor is connected between the bias resistance and a first node;
a conduction channel of the third bipolar transistor is connected between the first node and the reference terminal;
the output current resistor is coupled between the reference terminal and a conduction channel of the first bipolar transistor;
the conduction channel of the first bipolar transistor is connected between the output current resistor and a second node;
a conduction of the second bipolar transistor is coupled between the second node and a reference current output terminal;
a base terminal of the fourth bipolar transistor is connected to a base terminal of the second bipolar transistor;
a base terminal of the third bipolar transistor is connected to the second node;
a base terminal of the first bipolar transistor is connected to the first node; and
the fourth bipolar transistor is arranged in a diode connected configuration.

In one or more embodiments a resistance value of the first output resistor may be based on a resistance value of the output current resistor and a temperature co-efficient of a collector-emitter voltage of the output bipolar transistor.

In one or more embodiments a resistance value of the first output resistor may be based on a resistance value of the output current resistor, a ratio of an effective size of the input bipolar transistor to an effective size of the output bipolar transistor, a ratio of an effective size of the first bipolar transistor to an effective size of the second bipolar transistor, a temperature coefficient of a thermal voltage of the first bipolar transistor and a temperature co-efficient of a collector-emitter voltage of the output bipolar transistor.

In one or more embodiments a resistance value of each further output resistor may be based on a resistance value of the output current resistor and a temperature co-efficient of a collector-emitter voltage of the corresponding further bipolar transistor.

In one or more embodiments a resistance value of each further output resistor is based on a resistance value of the output current resistor, a ratio of an effective size of the input bipolar transistor to an effective size of the output bipolar transistor, a ratio of an effective size of the first bipolar transistor to an effective size of the second bipolar transistor, a temperature coefficient of a thermal voltage of the first bipolar transistor and a temperature co-efficient of a collector-emitter voltage of the corresponding further bipolar transistor.

In one or more embodiments the reference current generator may further comprise a PMOS mirror configured to mirror the reference current from the reference current output terminal to the regulator stage.

In one or more embodiments a resistance value of the first output resistor and any further output resistors are further based on an effective size ratio of the PMOS current mirror.

In one or more embodiments the first to fourth bipolar transistors may be NPN bipolar transistors.

In one or more embodiments, based on a temperature coefficient of the output current resistor, the reference current generator may be one of:

a proportional to absolute temperature, PTAT, current generator;
a complementary to absolute temperature, CTAT, current generator; and
a temperature independent current generator.

In one or more embodiments effective sizes of the second, third and fourth bipolar transistors may be substantially the same.

In one or more embodiments an effective size of the first bipolar transistor may be greater than the effective size of the second bipolar transistor.

In one or more embodiments the regulator stage may further comprise a feedback capacitor coupled between the gate of the NMOS transistor and the reference terminal.

In one or more embodiments the voltage regulator may further comprise an output capacitor coupled between the output terminal and the reference terminal.

According to a second aspect of the present disclosure there is provided a battery management system comprising any of the voltage regulators disclosed herein.

According to a further aspect of the present disclosure there is provided a voltage regulator comprising:

a supply terminal configured to receive a supply voltage;
a reference terminal;
an output terminal configured to provide a regulated output voltage;
a reference current generator coupled between the supply terminal and the reference terminal and configured to provide a reference current that is independent of an operating range of the supply voltage; and
a regulator stage configured to receive the reference current from the reference current generator, the regulator stage comprising:
  a NMOS transistor with a conduction channel coupled between the supply terminal and the output terminal;
  a bipolar current mirror; and
  a first output resistor, wherein, a conduction channel of an output bipolar transistor of the bipolar current mirror and the first output resistor are coupled in series between the output terminal and the reference terminal to form a voltage reference circuit configured to provide the regulated output voltage and wherein the NMOS transistor, the bipolar current mirror and the first output resistor are arranged in a negative feedback loop and configured to pull a mirrored reference current from the NMOS transistor through the first output resistor and the output bipolar transistor.

While the disclosure is amenable to various modifications and alternative forms, specifics thereof have been shown by way of example in the drawings and will be described in detail. It should be understood, however, that other embodiments, beyond the particular embodiments described, are possible as well. All modifications, equivalents, and alternative embodiments falling within the spirit and scope of the appended claims are covered as well.

The above discussion is not intended to represent every example embodiment or every implementation within the scope of the current or future Claim sets. The figures and Detailed Description that follow also exemplify various example embodiments. Various example embodiments may be more completely understood in consideration of the following Detailed Description in connection with the accompanying Drawings.

BRIEF DESCRIPTION OF THE DRAWINGS

One or more embodiments will now be described by way of example only with reference to the accompanying drawings in which.

DETAILED DESCRIPTION

Integrated circuits (IC) operating in a high-voltage environment with a large input power supply operating range can require a first voltage regulator, or pre-regulator, to enable optimisation of subsequent regulator stages such as the optimisation of die-size area through the use of low voltage devices. One such environment is a battery management system (BMS) for electric and hybrid vehicles.

Requirements of the pre-regulator may include a very low current consumption to support IC sleep mode current consumption, while being able to provide a large load current range when the IC is in full power mode.

The regulated output voltage of the pre-regulator may also have stringent accuracy requirements over variations in temperature, process, input/supply voltage and load to support minimum load voltage requirements and maximum voltage rating (to allow design of load functions with low voltage devices).

In some applications, such as a BMS, safety can also be a mandatory requirement, and pre-regulator output voltage monitoring can be required. This can include detection of over-voltage and under-voltage. As a result, a distribution range of over-voltage and under-voltage over process, temperature, voltage and mismatch should not overlap with the distribution of the pre-regulator output voltage in order to prevent false error detection. In other words, the over-voltage and under-voltage distributions should be independent of the pre-regulator's regulated output voltage distribution and all three distributions should fit between a maximum voltage rating limit and a minimum load voltage.

Figure 1:
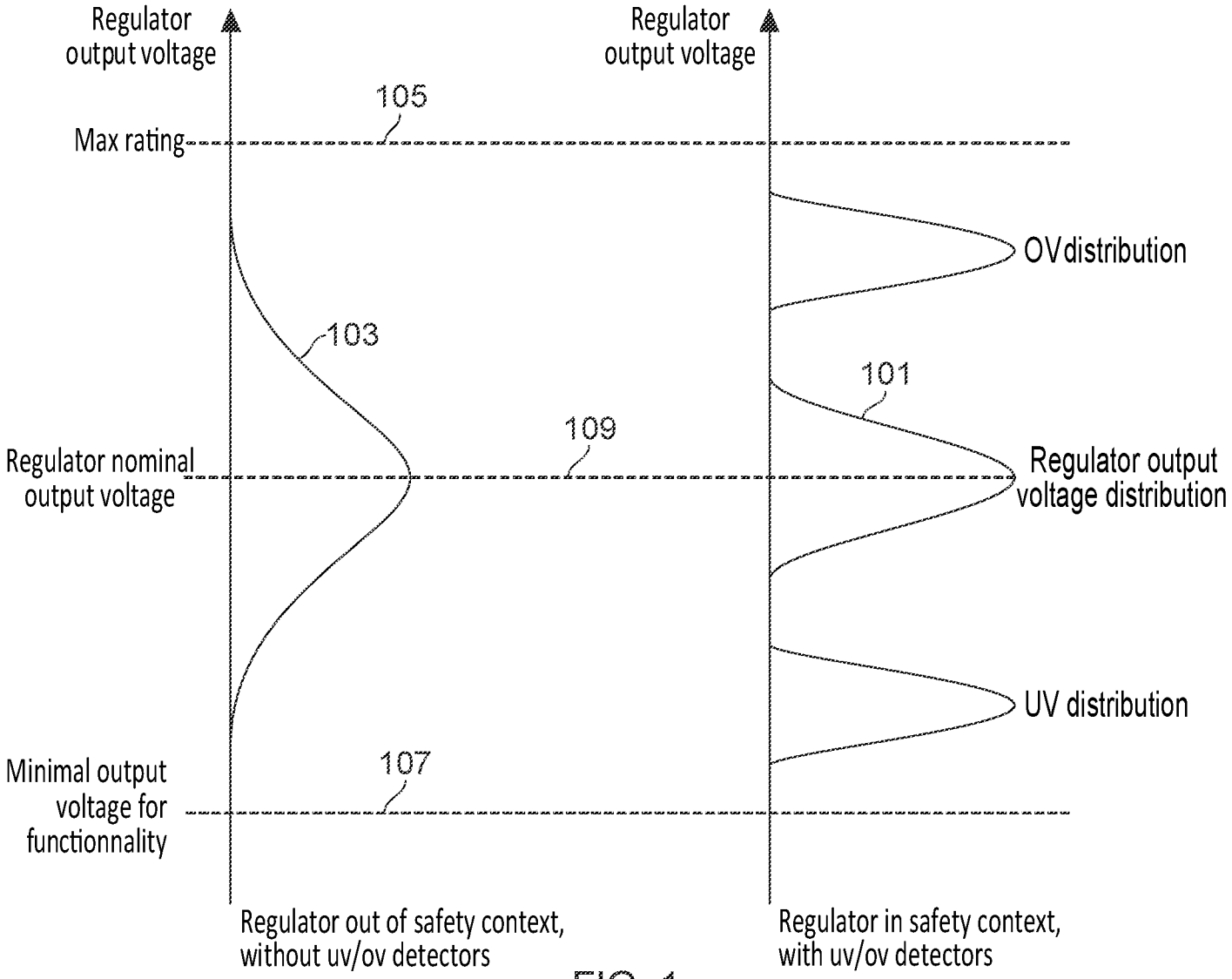
FIG. 1 shows distributions of a regulated output voltage of a pre-regulator with and without over-voltage and under-voltage detection requirements.

FIG. 1 illustrates distributions of a regulated output voltage 101, 103 of a pre-regulator with and without over-voltage and under-voltage detection requirements. The left-hand plot illustrates the distribution requirements of a pre-regulator with no safety requirement for over- or under-voltage detection. The distribution of the regulated output voltage 103 of the pre-regulator is only required to lie between a maximum voltage rating 105 and a minimum voltage rating 107 for functionality, centred on a nominal output voltage 109. The right-hand plot illustrates the distribution requirements of a pre-regulator with safety requirements for over and under-voltage regulation. An example of such requirements is Automotive Safety Integrity Level D (ASIL-D) required for BMS. The required distribution of the regulated output voltage 101, centred on the nominal output voltage 109 is much narrower to enable room for an over-voltage distribution 111 and an under-voltage distribution 113 between the upper and lower ratings 105, 107 without any overlap in the three distributions 101, 111, 113. Obtaining such an accurate distribution of regulated output voltage 101 can be challenging when no reference voltage or biasing current are available. This can be particularly challenging in high-voltage environments requiring a low power output for downstream regulators, such as in BMS.

Voltage regulators of the present disclosure can address the stringent requirements outlined above and provide a regulated output voltage with a narrow distribution over temperature, supply voltage and load. The regulators can provide up to tens of mA of load current and have a low quiescent current less than 15 μA.

Figure 2:
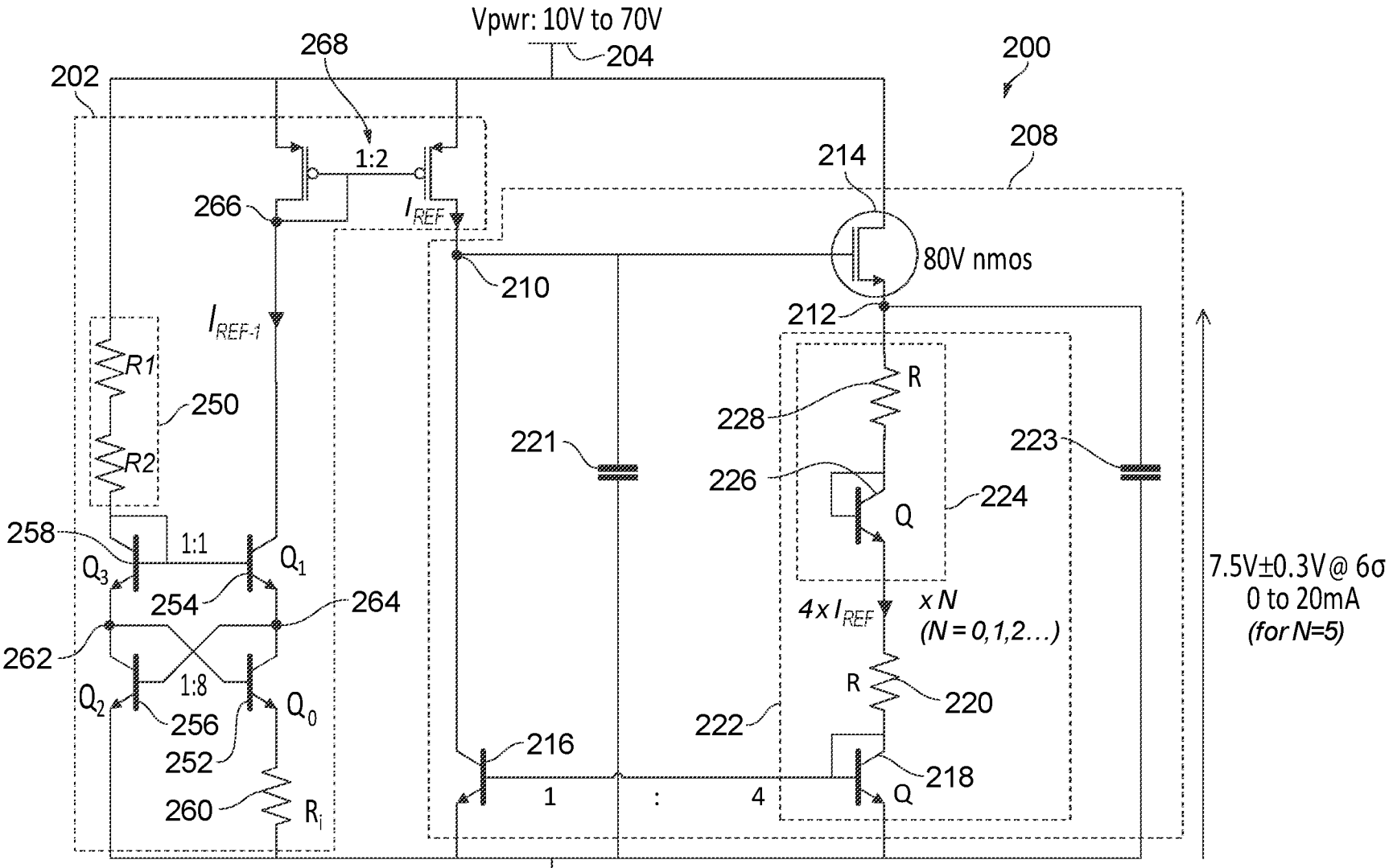
FIG. 2 shows a voltage regulator according to an example embodiment of the present disclosure.

FIG. 2 illustrates a voltage regulator 200 according to an embodiment of the present disclosure.

The voltage regulator 200 is configured to receive a supply voltage, Vpwr, with a large operating range at a supply terminal 204 and provide a regulated output voltage, $V_{out}$, at an output terminal 212. The regulated output voltage, Vow, can have a reduced temperature sensitivity with a resulting narrow voltage distribution (in this example, 7.5 V±4% at 6σ) over a wide range of load current (0 to tens of mA) and for a large supply voltage operating range (10 to 70 V). The voltage regulator can also have a low quiescent current.

The voltage regulator 200 comprises a reference current generator 202 coupled between the supply terminal 204 and the reference terminal 206. The reference current generator is configured to provide a reference current, $I_{REF}$, that is independent of an operating range of the supply voltage. The operating range of the supply voltage relates to the range of the supply voltage when the voltage regulator 200 is operating. In this example, the operating range of the supply voltage is 10 V to 70 V.

In this example, the reference current generator 202 comprises a bias resistance 250, a first bipolar transistor, $Q_0$, 252, a second bipolar transistor, $Q_1$, 254, a third bipolar transistor, $Q_2$, 256, a fourth bipolar transistor, $Q_3$, 258 and an output current resistor 260. In this example, the reference current generator 202 comprises NPN bipolar transistors. The bias resistance 250, the first to fourth bipolar transistors 252, 254, 256, 258, and the output resistance 260 produce a first reference current, $I_{REF\text{-}1}$, at a reference current output terminal 266.

The bias resistance 250 is coupled to the supply terminal 204 and to the reference terminal 206 via the third and fourth bipolar transistors 256, 258. The bias resistance 250 is configured to provide a bias current to a collector terminal of the fourth bipolar transistor 258. In this example, the bias resistance comprises a first bias resistor, R1, and a second bias resistor, R2. If both the first and second bias resistors comprise a resistance value of 20 MΩ and the supply voltage, Vpwr, has an operating range that can vary from 10 V to 70 V, then the biasing current provided to the fourth bipolar transistor 258 will vary from 200 nA to 1.75 μA.

The first to fourth bipolar transistors are arranged as follows: a collector terminal of the fourth bipolar transistor 258 is connected to the bias resistance 250; the fourth bipolar transistor is arranged in a diode-connected configuration with a base terminal and a collector terminal of the fourth bipolar transistor 258 connected together; an emitter terminal of the fourth bipolar transistor 258 is connected to a collector terminal of the third bipolar transistor 256 at a first node 262; an emitter terminal of the third bipolar transistor 256 is connected to the reference terminal 206; the output current resistor, $R_i$, 260 is coupled between the reference terminal 206 and an emitter terminal of the first bipolar transistor 252; a collector terminal of the first bipolar transistor 252 is connected to an emitter terminal of the second bipolar transistor 254; a collector terminal of the second bipolar transistor 254 is coupled to the reference current output terminal 266; the base terminal of the fourth bipolar transistor 258 is connected to a base terminal of the second bipolar transistor 254; a base terminal of the third bipolar transistor 256 is connected to the emitter terminal of the second bipolar transistor 254 and the collector terminal of the first bipolar transistor 252 at the second node 262; and a base terminal of the first bipolar transistor 252 is connected to the emitter terminal of the fourth bipolar transistor 258 and the collector terminal of the third bipolar transistor 256 at the first node 260.

In this example, a ratio of the effective size of the first bipolar transistor 252 to the second, third and fourth bipolar transistors 254, 256, 258 is 8:1:1:1. Here, effective size may relate to the size of a component on a semiconductor die. For example, an effective size of a bipolar transistor may be increased by stacking multiple bipolar transistors in parallel with common base, collector and emitter terminals.

Kirchoff's voltage law allows us to define the first reference output current, $I_{REF-1}$, in terms of the base-emitter voltages, $VBE_Q$, of the first to fourth bipolar transistors 252, 254, 256, 258 as follows:

$$I_{REF-1} \cdot R + VBE_{Q0} + VBE_{Q3} = VBE_{Q1} + VBE_{Q2}$$

Assuming the base current of the bipolar transistors is negligible compared to the biasing current and the first reference current, we get:

$$I_{REF-1} \cdot R_i + VBE_{Q0} = VBE_{Q1}$$

$$I_{REF-1} \cdot R_i + V_T \cdot \ln\left(\frac{I_{REF-1}}{\varphi_{gen} \cdot Is}\right) = V_T \cdot \ln\left(\frac{I_{REF-1}}{Is}\right)$$

$$I_{REF-1} = \frac{V_T \ln(\varphi_{gen})}{R_i}$$

where $V_T$ and $I_S$ are the thermal voltage and saturation current respectively of the bipolar transistors. The factor $\varphi_{gen}$ in the equation defines a ratio of the effective size of the first bipolar transistor 252 to the effective size of the second bipolar transistor 254 ($\varphi P_{gen}$=8 in this example). Therefore, the first reference current, $I_{REF-1}$, depends only on a resistance value, Ri, of the output current resistor 260 and the ratio, $\varphi_{gen}$, of the first and second bipolar transistors 252, 254. The first reference current, $I_{REF-1}$, is independent of any variation in the supply voltage, Vpwr, which can be particularly advantageous in battery management systems.

In addition to being independent of the supply voltage, Vpwr, a temperature dependence of the first reference current, $I_{REF-1}$, can also be controlled. A temperature dependence (or co-efficient) of the first reference current ($dI_{REF-1}/dT$) will depend on a temperature dependence of the thermal voltage ($dV_T/dT$) and a temperature dependence of the output current resistor 260 (dRi/dT). The temperature dependence of the thermal voltage is typically a positive constant ($V_T = k_b T/q$ (26 mV @25° C.)). Therefore, the reference current generator 202 providing the first reference current, $I_{REF-1}$, and reference current, $I_{REF}$, can be one of: (i) a proportional to absolute temperature, PTAT, current generator; (ii) a complementary to absolute temperature, CTAT, current generator; or a temperature independent current generator, depending on the relative values of $dR_i/dT$ and $dV_T/dT$. For example, if the output current resistor 260 is temperature independent (dRi/dT=0), the reference current generator 202 will be a PTAT current generator.

The reference current generator 202 may provide the first reference current, $I_{REF-1}$, to the regulator stage 208 as the reference current. In this example, an additional high-voltage mirror 268 mirrors the first reference current, $I_{REF-1}$, to produce the reference current, $I_{REF}$. In this example, the high-voltage mirror is a PMOS mirror, but in other examples it may comprise other components such as PNP transistors. The PMOS mirror comprises: a first PMOS transistor with a conduction channel coupled between the supply terminal 204 and the reference current output terminal 266; and a second PMOS transistor with a conduction channel coupled between the supply terminal and a current terminal 210 of the regulator stage 208. A gate of the first PMOS transistor is connected to a gate of the second PMOS transistor and the reference current output terminal 266. In this example, a ratio, $\varphi_{PMOS}$, of the effective size of the second PMOS transistor to an effective size of the first PMOS transistor is 2:1 such that the reference current, $I_{REF}$, is double the first reference current, $I_{REF-1}$.

The voltage regulator 200 further comprises a regulator stage 208. The regulator stage 208 comprises a current terminal 210 which receives the reference current, $I_{REF}$, from the reference current generator 202, a NMOS transistor 214, an input bipolar transistor 216, an output bipolar transistor 218 and a first output resistor 220. The first output resistor 220 and the conduction channel of the output bipolar transistor 218 are coupled in series between the output terminal 212 and the reference terminal 206 forming at least part of a voltage reference circuit 222 for providing the regulated output voltage, Vow. The input bipolar transistor 216 and output bipolar transistor 218 form a bipolar current mirror. The NMOS transistor 214, the bipolar current mirror 216, 218 and the first output resistor 220 are arranged in a negative feedback loop to pull a mirrored reference current from the NMOS transistor 214 through the first output resistor 220 and the output bipolar transistor 218.

The NMOS transistor 214 has a gate terminal coupled to the current terminal 210, a drain terminal coupled to the supply terminal 204, and a source terminal coupled to the output terminal 212. The NMOS transistor 214 can have a voltage rating higher than a maximum value of the operating range of the supply voltage, Vpwr.

The voltage reference circuit 222, coupled between the output terminal 212 and the reference terminal 206, comprises the first output resistor 220 coupled in series with a conduction channel of the output bipolar transistor 218. In this example, the output bipolar transistor 218 is arranged in a diode connected configuration with a base terminal connected to a first conduction channel terminal (collector terminal for a NPN transistor).

In this example, a first conduction channel terminal of the output bipolar transistor 218 is coupled to the reference terminal 206 and a second conduction channel terminal of the output bipolar transistor 218 is coupled to a first end of the first output resistor 220. A second end of the first output resistor 220 is coupled to the output terminal 212 either directly or via one or more further voltage reference blocks 224.

A conduction channel of the input bipolar transistor 216 is coupled between the current terminal 210 and the reference terminal 206. A base terminal of the input bipolar transistor 216 is coupled to a base terminal of the output bipolar transistor 218 forming a bipolar current mirror. In this way, the bipolar current mirror can mirror the reference current, $I_{REF}$, to produce a mirrored reference current in the voltage reference circuit 222. In other words, the bipolar current mirror may pull a mirrored reference current from the NMOS transistor 214 through the voltage reference circuit 222 to the reference terminal 206.

An effective size of the output bipolar transistor 218 may be different to an effective size of the input bipolar transistor 216. Here, effective size may relate to the size of a component on a semiconductor die. For example, an effective size of a bipolar transistor may be increased by stacking multiple bipolar transistors in parallel with common base, collector and emitter terminals. In this example, a ratio, $\varphi_{reg}$, of the effective size of the output bipolar transistor 218 to the effective size of the input bipolar transistor is 4:1. As a result, the mirrored reference current can be 4 times larger than the reference current, $I_{REF}$. In this way, the bipolar current mirror 216, 218 and the NMOS transistor 214 create a negative feedback loop forcing four times the reference current, $I_{REF}$, through the voltage reference circuit as the mirrored reference current.

In the illustrated example, the input bipolar transistor 216 and output bipolar transistor 218 are NPN transistors. In one or more examples, the nature (or type) of the bipolar transistors 216, 218 and the first output resistor 220 of the regulator stage 208 can be respectively the same as the bipolar transistors 252, 254, 256, 258 and the output current resistor 260 of the reference current generator 202. In other words, the bipolar transistors and resistors of the regulator stage 208 can be matched to the bipolar transistors and resistors used in the reference current generator 202. This matching can comprise the bipolar transistors and resistors sharing the same nature or type (NPN/PNP transistors, polyfused, metal layer etc resistors), same temperature coefficient/same temperature dependence, same fabrication process, same wafer, same time of manufacture, and/or same location on the layout, as is known in the art. This matching of the components of the regulator 208 and reference current generator 202 can compensate process variations and provide the same component temperature dependence. For example, any process variation in the components of the reference current generator 202 that leads to a variation in the nominal reference current, or a temperature dependence thereof, will be compensated by corresponding process variation in the components of the regulator stage 208.

In this example, the input and output bipolar transistors 216, 218 and the first to fourth bipolar transistors 252, 254, 256, 258 all share the same type. As a result, all of the bipolar transistors share the same temperature coefficient of their collector-emitter voltage, $dV_{CE}/dT$, (or base-emitter voltage, $dV_{BE}/dT$). Similarly, the first output resistor 228 and output current resistor 260 are of the same type and their resistances, R, Ri, share the same temperature coefficient (dR/dT).

The collector-emitter voltage, $V_{CE}$, across the output bipolar transistor 218 in the diode-connected configuration is equal to the base-emitter voltage, $V_{BE}$. The collector-emitter voltage, $V_{CE}$, (or the base-emitter voltage, $V_{BE}$, in a diode configuration) can comprise a fixed bandgap voltage and a complementary to absolute temperature, CTAT, voltage component, which has an inverse relationship with temperature. In this example, the NPN output bipolar transistor 218 arranged in a diode connected configuration has a fixed bandgap voltage of ~1.25 V.

A contribution of the output bipolar transistor 218 and the first output resistor 220 to the regulated output voltage, $V_{out}$, when the mirrored reference current flows through the voltage reference circuit 222, can be written as:

$$V_{out} = \underbrace{R \cdot (\varphi_{reg} \cdot I_{REF})}_{PTAT} + \underbrace{V_{CE}}_{CTAT}$$

In the equation, R is a resistance value of the first output resistor 220. As described above, the reference current, $I_{REF}$, is proportional to the thermal voltage, $V_T$, of the bipolar transistors of the reference current generator 202, divided by the resistance, $R_i$, of the output current resistor 260. As the output current resistor 260 and first output resistor 220 are of the same type and have the same temperature dependence (dR/dT=dRi/dT), the temperature dependence of the first term of the above equation depends on the temperature dependence of the thermal voltage, $V_T$, which is a positive constant. Therefore, the first term of the equation defines a PTAT voltage source. The regulated output voltage, $V_{out}$, comprises a sum of a PTAT voltage source and a CTAT voltage source. Therefore, the resistance value, R, of the first output resistor 220 can be selected to compensate the temperature coefficient of the voltage, $V_{CE}$ ($V_{BE}$ in this example), across the output bipolar transistor 218. As a result, the contribution of the diode-connected output bipolar transistor 218 and the first output resistor 220 to the regulated output voltage, $V_{out}$, can be insensitive to temperature variations and equal to the fixed bandgap voltage of 1.25 V. Therefore, the voltage reference circuit 222 of the voltage regulator 200 can provide a temperature independent regulated output voltage, $V_{out}$.

To balance the CTAT voltage component of the output bipolar transistor 218, the resistance value, R, of the first output resistor 220 may be based on the resistance, Ri, of the output current resistor 260, the effective size ratio, ($\varphi_{gen}$, of the first bipolar transistor 252 and the second bipolar transistor 254, the effective size ratio, ($\varphi_{PMOS}$, of the PMOS current mirror 268 (where applicable), the effective size ratio, ($\varphi_{reg}$, of the bipolar current mirror 216, 218, the temperature coefficient of the thermal voltage, $V_T$, of the bipolar transistors of the reference current generator 202 and a temperature co-efficient ($dV_{CE}/dT$) of the collector-emitter voltage across the output bipolar transistor 216. The relationship for the specific example of FIG. 2 can be derived as follows:

$$\frac{dV_{out}}{dT} = 0 \rightarrow \frac{dV_{CE}}{dT} + \frac{dV_R}{dT} = 0$$

$$-\frac{dV_{CE}}{dT} = \frac{d}{dT}(\varphi_{reg} \cdot R \cdot I_{REF})$$

$$-\frac{dV_{CE}}{dT} = \frac{d}{dT}\left(\varphi_{reg} \cdot R \cdot \varphi_{PMOS} \cdot \frac{V_T \ln(\varphi_{gen})}{R_i}\right)$$

-continued $$R = \frac{R_i}{\varphi_{reg} \cdot \varphi_{PMOS} \cdot \ln(\varphi_{gen})} \cdot \frac{-\frac{dV_{CE}}{dT}}{\frac{dV_T}{dT}}$$

Therefore, the resistance value, R, of the first output resistor 220 can be selected to balance the CTAT voltage component of the output bipolar resistor based on the resistance, Ri, of the output current resistor 260, the temperature co-efficient ($dV_T/dT$) of the thermal voltage, the temperature coefficient ($dV_{CE}/dT$) of the collector-emitter voltage of the output bipolar transistor and, where applicable, scaling ratios ($\varphi_{reg}$, $\varphi_{PMOS}$, $\ln(\varphi_{gen})$) of the voltage regulator 200. Equivalently, a ratio of the resistances R/Ri can also be selected. Also equivalently, each of: the resistance value, R, of the first output resistor 220; the resistance, Ri, of the output current resistor 260; and the scaling ratios ($\varphi_{reg}$, $\varphi_{PMOS}$, $\ln(\varphi_{gen})$) of the voltage regulator 200, can be selected to balance the CTAT voltage component of the output bipolar transistor. As there are a number of parameters that can be selected, there can be a number of different sets of values that satisfy the above equality. Therefore, other factors may be taken into consideration when selecting the values of the parameters. For example, for the voltage regulator of FIG. 2, an effective size ratio, ($\varphi$reg=4:1, for the output bipolar transistor to the input bipolar transistor provided an optimum trade-off between power consumption, resistor size and regulator speed (a higher current can provide a lower output impedance and provide better load regulation).

In this way, the output voltage, Vout, of the voltage regulator 200 can be insensitive to temperature variations. As the bipolar transistors and resistors of the reference current generator 202 and regulator stage 208 share are matched, the voltage regulator 200 can provide an output voltage, $V_{out}$, with high accuracy that is insensitive to any variation in process or environment.

In this example, the regulator stage 208 further comprises a feedback capacitor 221 coupled between the gate of the NMOS transistor 214 and the reference terminal 206. The feedback capacitor 221 can provide stability to the voltage regulator 200. The regulator stage 208 also comprises an output capacitor 223 coupled between the output terminal 212 and the reference terminal 206. Both the feedback capacitor 221 and the output capacitor 223 are on the order of a few picofarads and can be integrated on-chip. The low impedance provided by the presence of the NMOS transistor 214 at the output terminal 212 enables such low capacitances to be used while maintaining a stable circuit, particularly in response to changes in load.

In some examples, the voltage reference circuit 222 may only comprise the output bipolar transistor 218 and the first output transistor 220. In this way, the voltage reference circuit 222 can provide a temperature regulated output voltage, Vow, equal to the fixed bandgap voltage of the output bipolar transistor 218. In other examples, where a higher output voltage is required, the voltage reference circuit 222 may comprise one or more further voltage reference blocks 224.

Figure 4:
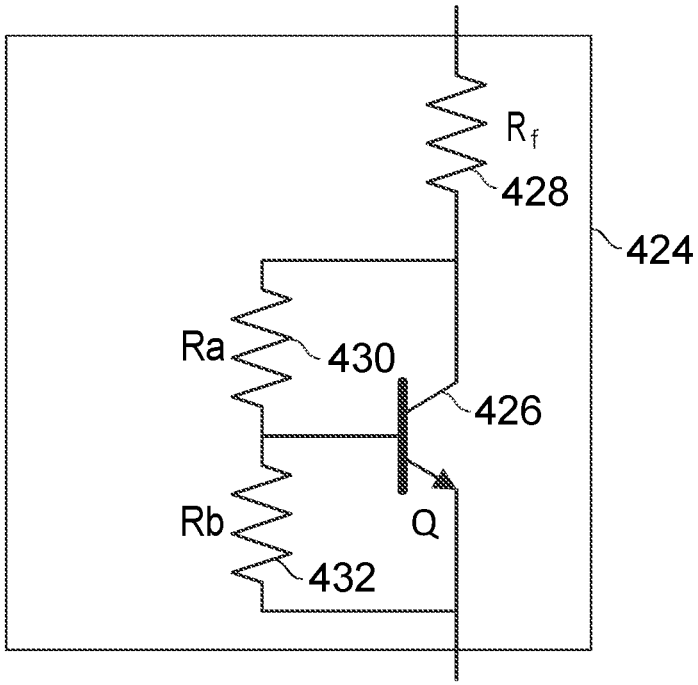
FIG. 4 shows a further voltage reference block according to an example embodiment of the present disclosure.
Figure 5:
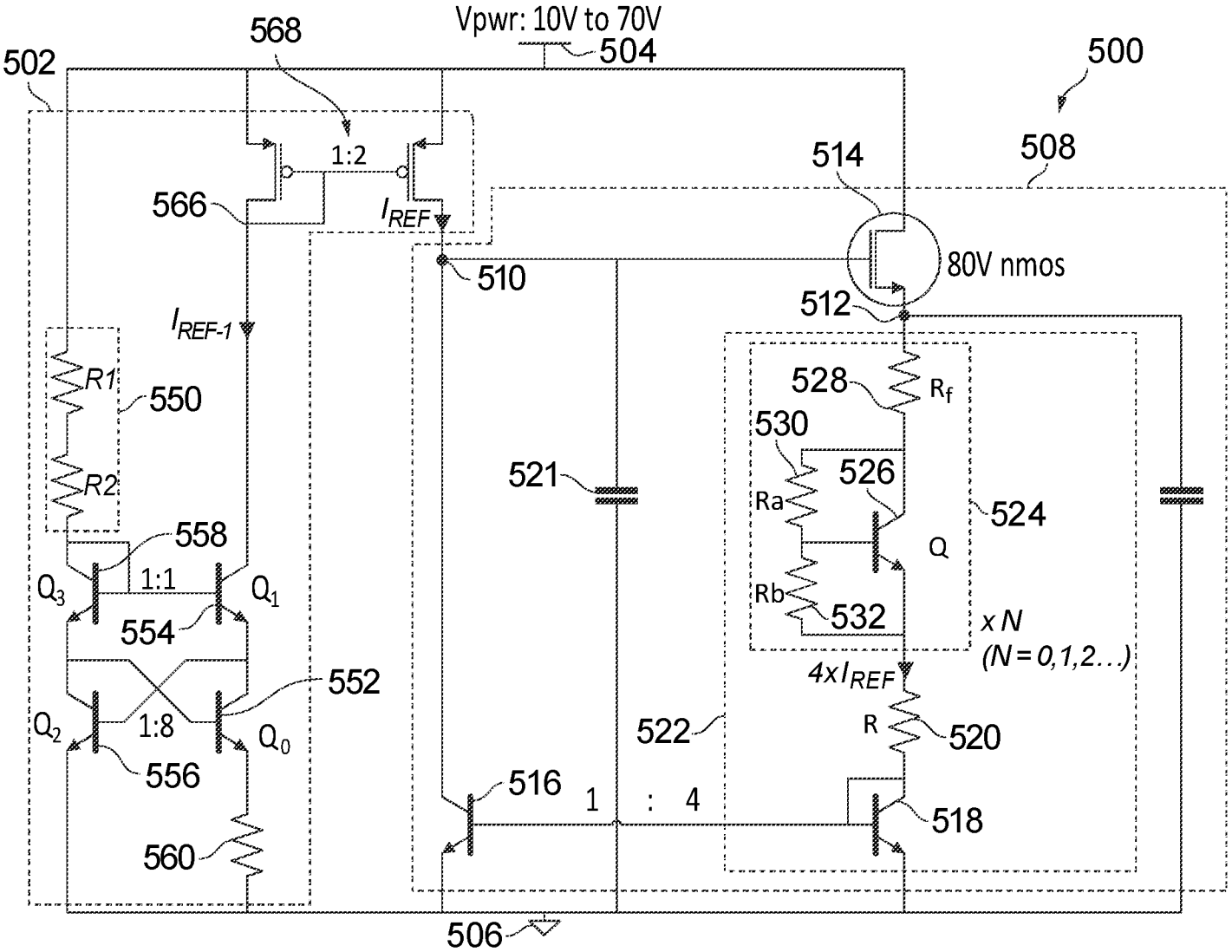
FIG. 5 shows a further voltage regulator according to an example embodiment of the present disclosure.

Each further voltage reference block 224 may comprise a further bipolar transistor 226 and a further output resistor 228. The further bipolar transistor 226 may be substantially the same as the output bipolar transistor and be of the same type. In this example the further bipolar transistor 226 of each further voltage reference block 224 comprises a NPN bipolar transistor that is nominally the same as the output bipolar transistor 218. In this example, the further bipolar transistor 226 is arranged in a diode-connected configuration, however in other examples, one or more further bipolar transistors 226 may be connected in other configurations, as illustrated in FIGS. 4 and 5. The further output resistor 228 may be substantially the same as the first output resistor 220, being of the same type (polyfused, metal film etc) and may have the same resistance value, R.

In the same way as described above for the output bipolar transistor/first output resistor pair, a voltage across each further resistor 228 can balance the CTAT component of the collector-emitter voltage, $V_{CE}$, across the respective further bipolar transistor 226 providing a temperature independent contribution to the regulated output voltage, $V_{out}$. In this way, each of the one or more further voltage reference blocks 224 can provide an additional temperature independent contribution to the output voltage, $V_{out}$. In this example, with the further bipolar transistors 226 arranged in the diode-connected configuration, each further voltage reference block can provide an additional 1.25 V contribution to the output voltage, $V_{out}$.

Figure 3:
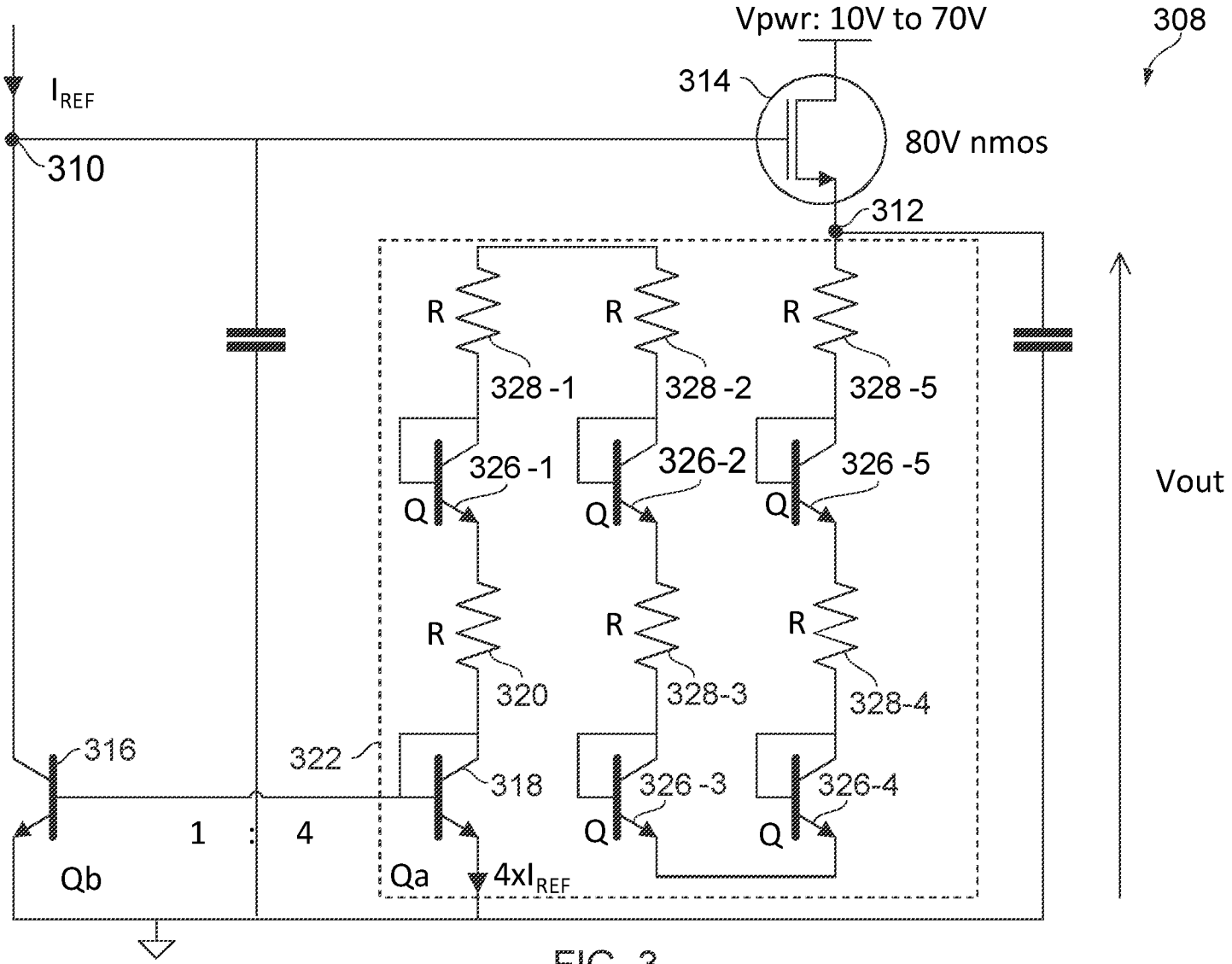
FIG. 3 shows another voltage regulator according to an example embodiment of the present disclosure.

FIG. 3 illustrates an example regulator stage 308 with a voltage reference circuit 322 comprising five further voltage reference blocks (N=5) in addition to the output bipolar transistor 318 and the first output resistor 320. The five further voltage reference blocks are shown expanded out. Each further voltage reference block comprises a further output resistor 328-1, 328-2, . . . 328-5 and a further diode-connected bipolar transistor 326-1, 326-2, . . . 326-5 nominally identical to the first output resistor 320 and the output bipolar transistor 318 respectively. The output bipolar transistor 318 and the each further bipolar transistor 326-1, 326-2, . . . 326-5 are arranged in a diode-connected configuration and the output voltage of the regulator stage 308 can be written as:

$$V_{out}=(N+1)\cdot(R\cdot(\varphi_{reg}\cdot I_{REF})+V_{CE})$$

$$V_{out}=6\cdot R\cdot(4\cdot I_{REF})+6\cdot V_{BE}$$

Therefore, if the resistance value, R, of the first and further output resistors 320, 328-1, 328-2, . . . 328-5 is selected to balance the CTAT voltage component of the voltage, $V_{BE}$, across the respective output and further bipolar transistors 318, 326-1, 326-2, . . . 326-5, the regulated output voltage, $V_{out}$, will be equal to six times the fixed bandgap voltage (6×1.25=7.5 V) and be temperature independent.

As discussed above, one or more further bipolar transistors may be arranged in configurations other than a diode-connected configuration. FIG. 4 illustrates a further voltage reference block 424 with a further bipolar transistor 426 connected in a resistor divider configuration according to further embodiments of the present disclosure.

The further voltage reference block 424 comprises a further output resistor 428 coupled in series with a conduction channel of the further bipolar transistor 426 as described above in relation to FIGS. 2 and 3. In addition, the further voltage reference block 424 comprises: a first division resistor, Ra, 430, coupled between a base terminal of the further bipolar transistor 426 and a first conduction channel terminal of the further bipolar transistor 426; and a second division resistor, Rb, 432, coupled between the base terminal of the further bipolar transistor 426 and a second conduction channel terminal of the further bipolar transistor 426.

The illustrated resistor divider configuration may be described as a k*$V_{BE}$ structure as it can supply any voltage higher than the fixed bandgap reference voltage of 1.25 V. Assuming the resistance values of the first and second division resistors 430, 432 are sufficiently large such that a current flowing through the first division resistor 430 and the second division resistor 432 is negligible compared to the current at the collector of the further bipolar transistor 428 (the mirrored reference current), the collector-emitter voltage, $V_{CE}$, can be written in terms of the base-emitter voltage, $V_{BE}$, as:

$$V_{CE} = V_{BE} \cdot \frac{Ra + Rb}{Rb}$$

Therefore, upon receipt of the mirrored reference current, the further voltage reference block 424 can provide a collector-emitter voltage, $V_{CE}$, proportional to the base-emitter voltage, $V_{BE}$, and greater than or equal to the classic diode-connected configuration illustrated in FIGS. 2 and 3 which provides 1.25 V. As described above in relation to FIG. 2, the resistance value, Rf, of the further output resistor 428 can be selected to compensate the CTAT coefficient of the collector emitter voltage, $V_{CE}$, of the further bipolar transistor 426. The equations and dependencies outlined above for determining the value of the first output resistor generally apply to determining the resistance value of the further output resistor 428. However, in the example of FIG. 4, the CTAT coefficient of the collector-emitter voltage, $V_{CE}$, of the further bipolar transistor in this example may differ from the CTAT coefficient of the base-emitter voltage, $V_{BE}$, described above in relation to the diode-connected configurations of FIGS. 2 and 3. Therefore, in this example, the resistance value, Rf, of the further output resistor 428 may differ from the resistance value, R, of the first output resistor. However, the temperature dependence of both resistors can remain the same (dR/dT=dRi/dT). Furthermore, aside from the differing resistance values, Rf, R, and the different connections of the transistors, each further bipolar transistor 426 and each further output resistor 428 is otherwise respectively matched to the output bipolar transistor and the first output resistor and also respectively matched to the bipolar transistors and the output current resistor of the reference current generator. In this way, the further voltage reference block 424 can provide a temperature and process independent regulated output voltage of any value greater than 1.25 V.

FIG. 5 illustrates another voltage regulator 500 according to an embodiment of the present disclosure. Features of FIG. 5 that are also shown in FIG. 2 have been given corresponding reference numbers in the 500 series and will not necessarily be described again here.

In this example, the voltage reference circuit 522 comprises a bipolar output transistor 518 arranged in a diode-connected configuration and a first output resistor 520. The voltage reference circuit 522 also comprises N (N=0, 1, 2 . . . ) further voltage reference blocks 524 each comprising a further bipolar transistor 526 and a further output resistor 528. Each further bipolar transistor 526 is arranged in the resistor divider configuration of FIG. 4. The voltage regulator 500 of FIG. 5 may therefore provide a versatile range of temperature independent output voltages by suitable selection of Ra, Rb and N.

The disclosed voltage regulators of FIGS. 2 and 5 can have a very low total quiescent current, even at high operating voltages of the supply voltage. The quiescent current is also independent of the load current. The quiescent current comprises contributions from the four branches of the circuits of FIGS. 2 and 5:

- The contribution from the first branch depends on the supply voltage, Vpwr and has a maximum value of ~2 μA.
- The contribution from the second branch, carrying the first reference current, $I_{REF-1}$, depends only on the temperature and the resistance value, $R_i$, of the output current resistor 260 and is typically on the order of 1 μA±20%.
- The contribution of the third branch, carrying the reference current, $I_{REF}$, is twice the second branch (due to the size ratio ($\varphi_{PMOS}$=2) of the PMOS mirror 268) and approximately 2 μA±20%.
- The contribution of the fourth branch, carrying the mirrored reference current, is four times the third branch (due to the size ratio ($\varphi_{reg}$=2) of the output bipolar transistor 218 to the input bipolar transistor 216) and approximately 8 μA±20%.

Therefore, the voltage regulators of FIGS. 2 and 5 can have a maximum quiescent current of approximately 15 μA for a load current of 0 to 20 mA. The quiescent current is also independent of any load current.

For the disclosed voltage regulators, the high-voltage NMOS transistor, the input bipolar transistor and the voltage reference circuit form a closed-loop regulator stage of the voltage regulator. The input bipolar transistor and the voltage reference circuit can be considered as a feedback network. The feedback network may also comprise the feedback capacitor. The feedback network can be matched with the reference current generator. In other words, the bipolar transistors and resistors of the regulator stage can be matched to the bipolar transistors and resistors used in the reference current generator. This matching can comprise the bipolar transistors and resistors sharing the same type (NPN/PNP transistors, polyfused, metal layer etc resistors), same temperature dependence, same fabrication process, same wafer, same time of manufacture, and/or same location on the layout, as is known in the art. This matching of the feedback network to the reference current generator can compensate process variations and provide the same component temperature dependence. For example, any process variation in the components of the reference current generator that leads to a variation in the nominal reference current will be compensated by corresponding process variation in the components of the regulator stage.

The negative feedback loop provided by the NMOS transistor and the feedback network can pull a large current from the supply terminal, through the NMOS transistor, maintaining a fixed regulator output voltage, $V_{out}$, over a wide range of load currents (up to tens of mA) with a high degree of accuracy. For example, the voltage regulator of FIG. 2 can maintain a regulated output voltage and distribution/accuracy of 7.5 V±4% at 6σ. Furthermore, the accurate output voltage can be provided without requiring output trimming.

The disclosed voltage regulators provide a low impedance output which can enable a fast-transient response to strong line regulation or load regulation variations. If a load current decreases in a step-wise manner then the negative feedback loop of the regulator stage can rapidly respond to maintain the regulated output voltage, $V_{out}$. The low impedance output can also have reduced sensitivity to variations in load mismatch.

The disclosed voltage regulators also provide a high-value power supply rejection ratio (PSSR) maintaining the accurate regulated output voltage distribution over a wide operating range of the supply voltage, Vpwr. The high PSSR can be maintained as long as the high-voltage NMOS transistor and the high-voltage PMOS current mirror (discussed below) have sufficient saturation margin.

In summary, the disclosed voltage regulators comprise an arrangement of:

1. A reference current source with a low sensitivity to variations in input bias current and supply voltage; and
2. A closed-loop regulator stage using a high voltage NMOS pass device and a feedback network matched with the reference current source. The regulator stage can generate an output voltage proportional to a bandgap voltage, with a scaling factor set by the circuit topology.

The disclosed voltage regulators can be considered as self-referenced and self-biased voltage regulators with a minimal quiescent current that is independent from any load current. The voltage regulators can provide an accurate regulated output voltage over a wide load current and/or power supply voltage range.

The disclosed voltage regulators can be used in any power management IC operating in an environment with a wide operating range of input/supply voltage. The disclosed voltage regulators can be particularly advantageous in applications where current consumption is critical (particularly at low loads). The disclosed voltage regulators may find particularly advantageous application in battery management systems, such as battery management systems for electric or hybrid vehicles.

The voltage regulators can support a wide range of high-power supply voltages while delivering minimal low power mode current consumption. Moreover, the robustness and accuracy of the voltage regulator can simplify downstream voltage regulator stages and save die-size.

The instructions and/or flowchart steps in the above figures can be executed in any order, unless a specific order is explicitly stated. Also, those skilled in the art will recognize that while one example set of instructions/method has been discussed, the material in this specification can be combined in a variety of ways to yield other examples as well, and are to be understood within a context provided by this detailed description.

In some example embodiments the set of instructions/method steps described above are implemented as functional and software instructions embodied as a set of executable instructions which are effected on a computer or machine which is programmed with and controlled by said executable instructions. Such instructions are loaded for execution on a processor (such as one or more CPUs). The term processor includes microprocessors, microcontrollers, processor modules or subsystems (including one or more microprocessors or microcontrollers), or other control or computing devices. A processor can refer to a single component or to plural components.

In other examples, the set of instructions/methods illustrated herein and data and instructions associated therewith are stored in respective storage devices, which are implemented as one or more non-transient machine or computer-readable or computer-usable storage media or mediums. Such computer-readable or computer usable storage medium or media is (are) considered to be part of an article (or article of manufacture). An article or article of manufacture can refer to any manufactured single component or multiple components. The non-transient machine or computer usable media or mediums as defined herein excludes signals, but such media or mediums may be capable of receiving and processing information from signals and/or other transient mediums.

Example embodiments of the material discussed in this specification can be implemented in whole or in part through network, computer, or data based devices and/or services. These may include cloud, internet, intranet, mobile, desktop, processor, look-up table, microcontroller, consumer equipment, infrastructure, or other enabling devices and services. As may be used herein and in the claims, the following non-exclusive definitions are provided.

In one example, one or more instructions or steps discussed herein are automated. The terms automated or automatically (and like variations thereof) mean controlled operation of an apparatus, system, and/or process using computers and/or mechanical/electrical devices without the necessity of human intervention, observation, effort and/or decision.

It will be appreciated that any components said to be coupled may be coupled or connected either directly or indirectly. In the case of indirect coupling, additional components may be located between the two components that are said to be coupled.

In this specification, example embodiments have been presented in terms of a selected set of details. However, a person of ordinary skill in the art would understand that many other example embodiments may be practiced which include a different selected set of these details. It is intended that the following claims cover all possible example embodiments.

The invention claimed is:

1. A voltage regulator comprising:

a supply terminal configured to receive a supply voltage;

a reference terminal;

an output terminal configured to provide a regulated output voltage;

a reference current generator coupled between the supply terminal and the reference terminal and configured to provide a reference current that is independent of an operating range of the supply voltage; and a regulator stage comprising:

a current terminal configured to receive the reference current from the reference current generator;

a NMOS transistor having:

a gate terminal coupled to the current terminal;

a drain terminal coupled to the supply terminal; and a source terminal coupled to the output terminal;

a voltage reference circuit coupled between the output terminal and the reference terminal and configured to provide the regulated output voltage, the voltage reference circuit comprising a first output resistor coupled in series with a conduction channel of an output bipolar transistor, wherein the output bipolar transistor is arranged in a diode-connected configuration;

an input bipolar transistor having: a conduction channel coupled between the current terminal and the reference terminal; and a base terminal coupled to a base terminal of the output bipolar transistor such that the input bipolar transistor and the output bipolar transistor form a bipolar current mirror for mirroring the reference current through the voltage reference circuit.

2. The voltage regulator of claim 1, wherein:

the input bipolar transistor and the output bipolar transistor are matched to bipolar transistors of the reference current generator; and the first output resistor is matched to an output current resistor of the reference current generator.

3. The voltage regulator of claim 2, wherein:

the input bipolar transistor and the output bipolar transistor are matched to the bipolar transistors of the reference current generator by each transistor sharing one or more of: a same type, a same temperature coefficient, a same fabrication process, a same wafer, a same time of manufacture and/or a same location on the layout; and the first output resistor is matched to the output current resistor of the reference current generator by each resistor sharing one or more of: a same type, a same temperature coefficient, a same fabrication process, a same wafer, a same time of manufacture and/or a same location on the layout.

4. The voltage regulator of claim 1, wherein the voltage reference circuit comprises one or more further voltage reference blocks coupled in series with the first output resistor and the output bipolar transistor between the output terminal and the reference terminal, each further voltage reference block comprising:

a further output resistor; and a further bipolar transistor arranged having a conduction channel connected in series with the further output resistor.

5. The voltage regulator of claim 4, wherein the further bipolar transistor is arranged in a diode connected configuration.

6. The voltage regulator of claim 4, wherein the further voltage reference block comprises:

a first further division resistor coupled between a base terminal of the further bipolar transistor and a first conduction channel terminal of the further bipolar transistor; and a second further division resistor coupled between the base terminal of the further bipolar transistor and a second conduction channel terminal of the further bipolar transistor.

7. The voltage regulator of claim 4, wherein:

each further bipolar transistor is matched to the output bipolar transistor and bipolar transistors of the reference current generator; and each further output resistor is matched to the first output resistor and an output current resistor of the reference current generator.

8. The voltage regulator of claim 1, wherein the reference current generator comprises:

a bias resistance;

a first bipolar transistor;

a second bipolar transistor;

a third bipolar transistor;

a fourth bipolar transistor; and an output current resistor, wherein:

the bias resistance is coupled to the supply terminal and configured to provide a bias current to a conduction channel of the fourth bipolar transistor;

the conduction channel of the fourth bipolar transistor is connected between the bias resistance and a first node;

a conduction channel of the third bipolar transistor is connected between the first node and the reference terminal;

the output current resistor is coupled between the reference terminal and a conduction channel of the first bipolar transistor;

the conduction channel of the first bipolar transistor is connected between the output current resistor and a second node;

a conduction of the second bipolar transistor is coupled between the second node and a reference current output terminal;

a base terminal of the fourth bipolar transistor is connected to a base terminal of the second bipolar transistor;

a base terminal of the third bipolar transistor is connected to the second node;

a base terminal of the first bipolar transistor is connected to the first node; and the fourth bipolar transistor is arranged in a diode connected configuration.

9. The voltage regulator of claim 8, wherein a resistance value of the first output resistor is based on a resistance value of the output current resistor and a temperature co-efficient of a collector-emitter voltage of the output bipolar transistor.

10. The voltage regulator of claim 8, wherein the reference current generator further comprises a PMOS mirror configured to mirror the reference current from the reference current output terminal to the regulator stage.

11. The voltage regulator of claim 8, wherein based on a temperature coefficient of the output current resistor, the reference current generator is one of:

a proportional to absolute temperature, PTAT, current generator;

a complementary to absolute temperature, CTAT, current generator; and a temperature independent current generator.

12. The voltage regulator of claim 11, wherein a resistance value of each further output resistor is based on a resistance value of the output current resistor and a temperature co-efficient of a collector-emitter voltage of the corresponding further bipolar transistor.

13. The voltage regulator of claim 8, wherein effective sizes of the second, third and fourth bipolar transistors are substantially the same.

14. The voltage regulator of claim 8, wherein an effective size of the first bipolar transistor is greater than the effective size of the second bipolar transistor.

15. The voltage regulator of claim 8, wherein a resistance value the first output resistor is based on a resistance value of the output current resistor, a ratio of an effective size of the input bipolar transistor to an effective size of the output bipolar transistor, a ratio of an effective size of the first bipolar transistor to an effective size of the second bipolar transistor, a temperature coefficient of a thermal voltage of the first bipolar transistor and a temperature co-efficient of a collector-emitter voltage of the output bipolar transistor.

16. The voltage regulator of claim 8, wherein the voltage reference circuit comprises one or more further voltage reference blocks coupled in series with the first output resistor and the output bipolar transistor between the output terminal and the reference terminal, each further voltage reference block comprising:

a further output resistor; and a further bipolar transistor arranged having a conduction channel connected in series with the further output resistor.

17. The voltage regulator of claim 8, wherein the reference current generator further comprises a PMOS mirror configured to mirror the reference current from the reference current output terminal to the regulator stage.

18. The voltage regulator of claim 1, wherein the regulator stage further comprises a feedback capacitor coupled between the gate of the NMOS transistor and the reference terminal.

19. A battery management system comprising the voltage regulator of claim 1.

20. A voltage regulator comprising:

a supply terminal configured to receive a supply voltage;

a reference terminal;

an output terminal configured to provide a regulated output voltage;

a reference current generator coupled between the supply terminal and the reference terminal and configured to provide a reference current that is independent of an operating range of the supply voltage; and a regulator stage configured to receive the reference current from the reference current generator, the regulator stage comprising:

a NMOS transistor with a conduction channel coupled between the supply terminal and the output terminal;

a bipolar current mirror; and a first output resistor, wherein, a conduction channel of an output bipolar transistor of the bipolar current mirror and the first output resistor are coupled in series between the output terminal and the reference terminal to form a voltage reference circuit configured to provide the regulated output voltage and wherein the NMOS transistor, the bipolar current mirror and the first output resistor are arranged in a negative feedback loop and configured to pull a mirrored reference current from the NMOS transistor through the first output resistor and the output bipolar transistor.

* * * * *